United States Patent [19]

Linnemann

[11] Patent Number: 4,934,654

[45] Date of Patent: Jun. 19, 1990

[54] VALVE FOR BULK CONTAINER

[75] Inventor: Kent A. Linnemann, Cincinnati, Ohio

[73] Assignee: Shippers Paper Products Company, Loveland, Ohio

[21] Appl. No.: 433,913

[22] Filed: Nov. 9, 1989

[51] Int. Cl.[5] ..... F16K 51/00

[52] U.S. Cl. ..... 251/144; 251/90; 251/95; 251/292; 220/465

[58] Field of Search ..... 251/292, 90, 95, 305, 251/144, 143; 220/462, 465; 137/380, 381

[56] References Cited

U.S. PATENT DOCUMENTS

| | | | |
|---|---|---|---|
| 1,512,333 | 10/1924 | Harberson | 251/95 |
| 2,780,333 | 2/1957 | Reiser et al. | 251/292 |
| 3,108,732 | 10/1963 | Curie et al. | 220/465 |
| 3,226,002 | 12/1965 | Walker | 220/465 |
| 3,448,889 | 6/1969 | Malpas | 220/465 |
| 3,957,033 | 5/1976 | Winchell et al. | 251/292 |
| 4,266,567 | 5/1981 | Pease | 251/143 |

*Primary Examiner*—A. Michael Chambers

*Attorney, Agent, or Firm*—Wood, Herron & Evans

[57] ABSTRACT

A valve for a bulk container containing fluid or semi-fluid material permitting draining of the container by gravity including a valve body with a throughopening therethrough, an annular flange at one end of the valve body to be sealingly secured to a plastic bag in the container containing the material and permitting flow of the material from the bag through the throughopening of the valve, an annular recess spaced from the flange a distance generally equal to the thickness of the side wall of the container for receiving a handle securing the valve body in the container side wall, and a butterfly in the throughopening to selectively open and close the valve.

5 Claims, 1 Drawing Sheet

VALVE FOR BULK CONTAINER

BACKGROUND OF THE INVENTION

This invention relates to a bulk container for storing and shipping fluid and semi-fluid materials in bulk, such as fluid and semi-fluid adhesives and, more particularly, to a valve permitting the emptying of said container.

In the storing and shipping of fluid and semi-fluid materials used in bulk quantities such as liquid adhesives and glues, it is known to ship these materials in bulk containers which comprise a generally cylindrical tubular side wall member set in an annular base and covered at the top. The container is typically mounted on a wooden pallet and strapped thereto permitting its movement by a forklift truck.

In one form of bulk container developed by the assignee of this invention, the container is formed of a paper tube having a plurality of unique, multiple-ply, formed and folded paperboard slats adhered to the paper tube in substantially edge abutting relationship. The abutting paperboard slats form the outside side wall of the container and provide the container with substantially increased strength and ease and economy of manufacture. The side wall is seated in an angular, annular base and contains a plastic bag to receive and contain the fluid or semi-fluid material placed therein. Metal or plastic bands are placed around the side wall at vertically spaced intervals and are used to secure the container in the circumferential direction. After filling, the plastic bag is closed and secured and a top placed on the side wall. The entire bulk container is then secured to a pallet by metal or plastic bands passing therearound.

SUMMARY OF THE INVENTION

This invention is directed to a valve for use with such a bulk container to permit draining of the material contained therein by gravity. The valve includes a tubular valve body having a opening extending therethrough, valve means mounted in the through opening and being movable from outside of the bulk container between a valve open and valve closed position, an annular flange at one end of the valve body adapted to be joined to the plastic bag in the bulk container, and an annular recess in the valve body spaced from the annular flange by a distance equal to about the thickness of the side wall of the bulk container. The valve further includes a handle receivable in the recess. In use, the valve is designed to pass through an opening in the side wall of the bulk container with the annular flange being inside the container and being welded or otherwise joined to the plastic bag in the container and the annular recess being on the outside of the side wall of the container. The handle is insertable into the annular recess in the valve body to thereby secure the valve in the opening of the side wall with the side wall being captured between the annular flange and the handle. The valve may further include one or more projections receivable in notches in the side wall to prevent rotation of the valve in the side wall of the bulk container. The end of the valve body opposite the annular flange may be threaded to receive a threaded closure cap.

DETAILED DESCRIPTION OF THE INVENTION

Figure 1:
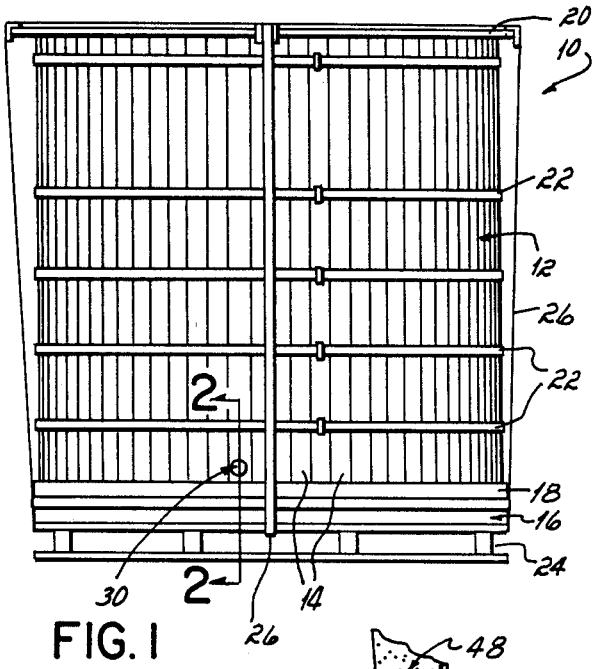
FIG. 1 is an elevation view of a bulk container showing the location of the valve of the present invention.

Referring now to FIG. 1, a bulk container 10 to which this invention in particularly applicable is illustrated. The container 10 is formed by a paper tubular side wall 12 which has adhered to it a plurality of paperboard slats 14 in substantially edge abutting relationship and extending in a vertical direction from top to bottom of said side wall 12. Preferably, the paperboard slats 14 are formed by laminating a number of plys of paper and forming, folding, and adhering them in the form of an overlapping folded slat. The side wall 12 of the bulk container sits in an annular base 16 having a vertical wall 18 preventing outward bulging of the side wall 12 at its base. A cap 20 is provided on the top of the container 10 for closing it after it is filled. A number of metal or plastic bands 22 pass around the circumference of the container 10 at vertically spaced locations to provide the container with resistance to outward bulging. The container can be mounted on a pallet 24 for movement by a forklift truck and secured thereto by straps 26 passing over the bulk container 10 and around the pallet 24.

In such a bulk container, a plastic bag (not shown in FIG. 1) is placed therein for containing the fluid or semi-fluid material being shipped in the container. The container is typically filled from the top by filling of the plastic bag at its open end. The bag is then sealed at the top and the container closed with the top cover 20.

Figure 2:
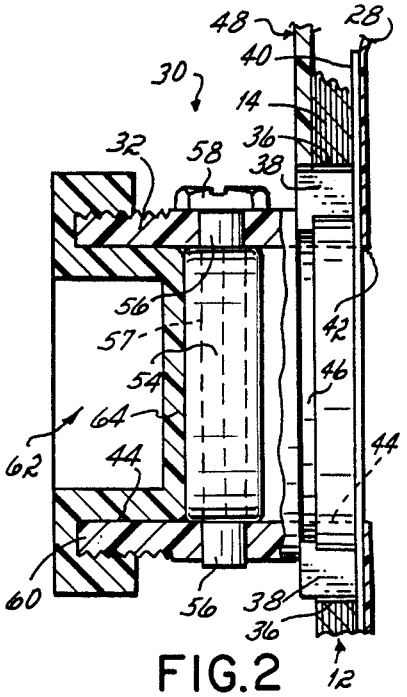
FIG. 2 is a cross-sectional view taken along line 2—2 of FIG. 1.

Referring now to FIG. 2, there is shown a cross-section of the bulk container 10 showing the relative location of the paperboard slats 14 of the side wall 12 and the plastic bag 28 contained therein. The valve 30 of the present invention is adapted to be welded to the plastic bag 28 and passed through the side wall 12 of the bulk container 10 at its base permitting draining of the container by gravity.

Figure 3:
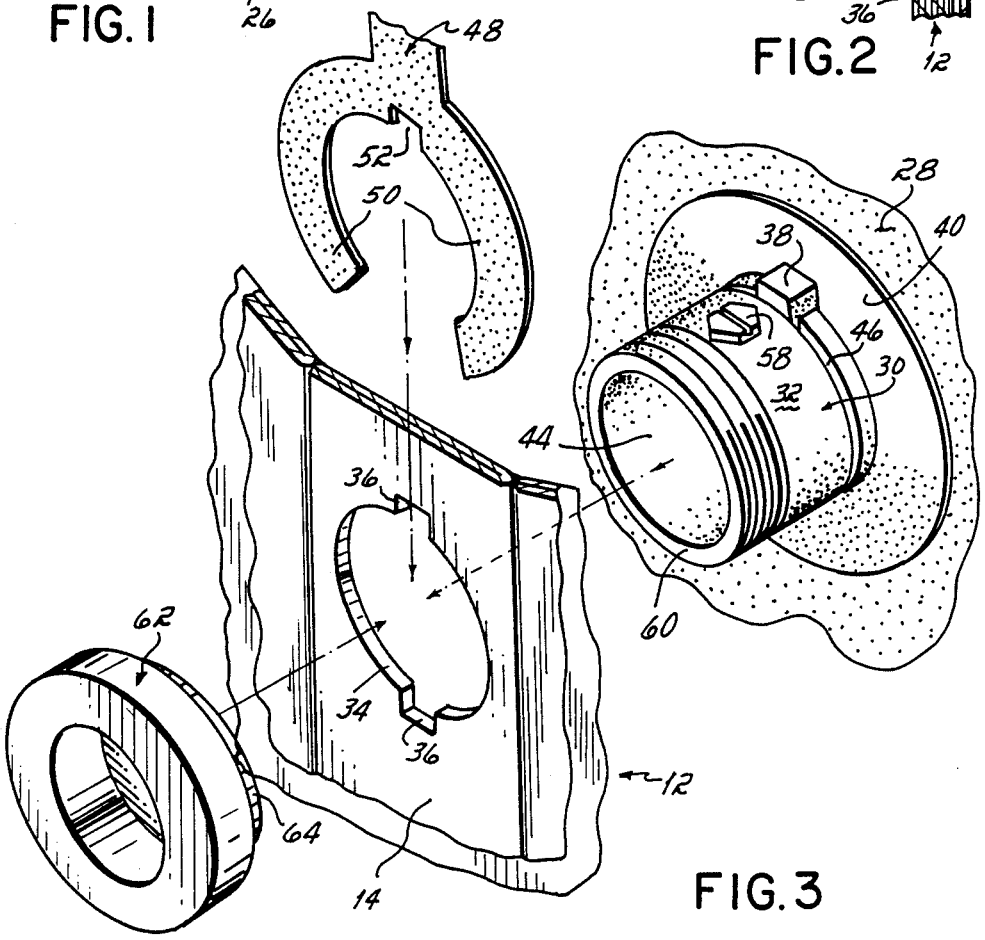
FIG. 3 is an exploded isometric view showing the mounting of the valve of the present invention in the side wall of the bulk container.

Referring now to FIGS. 2 and 3, the valve 30 of the present invention comprises a tubular valve body 32 which may be made of plastic and which is adapted to pass through a circular opening 34 in the side wall 12 of the container 10. Preferably, the opening 34 in the side wall 12 of the container 10 includes a pair of notches 36 through which projections 38 on the valve body 32 pass and interlock to prevent rotation of the valve body 32 in the side wall 12. The valve 30 includes at one end a plastic annular flange 40 which is adapted to be welded or otherwise joined to the plastic bag 28, for example, by means heat or ultrasonic welding. This secures the valve 30 to the plastic bag 28 and an opening 42 in the plastic bag 28 communicates with through opening 44 in the valve body 32 to permit draining of the material contained in the plastic bag 28 in the bulk container through the valve 30.

Accordingly, in use, the plastic bag 28 with valve 30 welded thereto is placed in the container and the tubular valve body 32 is passed from inside out through the circular opening 34 in the side wall 12 of the bulk container 10 with the projections 38 registering with the notches 36 extending from the circular opening 34. The valve body 32 includes an annular recess 46 which is spaced from the annular flange 40 by a distance generally equal to about the thickness of the side wall 12 (including slat 14) of the bulk container 10. A handle 48, which is likewise formed of plastic, includes a pair of semi-circular tangs 50 which are flexible enough to flex about the valve body 32 and seat in the annular recess 46 to secure the valve 30 in the side wall 12 of the bulk container 10. The handle 48 likewise includes a slot 52 which receives one of the projections 38 to prevent the handle 48 from rotating on the valve body 32. A valve closure member 54 is mounted in the through opening 44 such as a butterfly which is pivotal on a pin 56 extending into the tubular valve body 32. The pin 56 includes an external slotted head 58 which permits the butterfly to be turned by a screwdriver from outside the bulk container 40 to open and close the valve 30. The pin is square in cross-sectional shape where it passes through a like square cross-section opening 57 in the butterfly 54. In a presently preferred form of the invention, the pin is made of a glass filed polycarbonate. The butterfly is made of thermal rubber sold under the trademark "Saniprene" by the Monsanto Company. The end 60 opposite the annular flange of the tubular valve body 32 is externally threaded to receive a closure cap 62 which may be screwed thereon. The closure cap 62 includes a recessed portion 64 sized such that when the cap 62 is screwed on the valve body 32 it engages the butterfly 54 to prevent its rotation (opening) either accidentally or by the hydrostatic force of the material contained in the container. This provides an extra caution preventing any leaking of the valve 30 as might be occasioned by the accidental opening of the valve during transit. Likewise, if there is any leakage around the butterfly 54, the available volume is greatly limited.

In operation, the bulk container is typically shipped in a knockdown condition wherein the base 16 the top cap 20 and the plastic bag 28 are shipped with the top cap 20 sitting on base 16. The side wall 12 is shipped in a folded, flat configuration. To erect the bulk container 10, the top cap 20 is removed from the base 16 and the plastic bag with the valve 30 attached thereto. The side wall 12 is then formed into its tubular configuration and the plastic bag 28 is dropped into the side wall from the top, and the valve body 30 which is secured to the plastic bag 28 along the annular flange 40 is passed through the opening 34 in the bulk container side wall 12 with the projections 38 passing through the notches 36 in the circumference of the opening 34. The handle 48 is placed into engagement with the valve body 32 by pushing it toward the valve body 32 with the tangs 50 flexing thereabout and then snapping back to seat in the annular recess 46 thereby capturing the side wall 12 between the handle 48 and the annular flange 40. The annular flange 40 prevents any outward movement of the valve body 30 while the handle 48 prevents any inward movement thereof. The top of the plastic bag is then draped over the top of the side wall and the side wall is seated in the base 16 to permit filling. The butterfly 54 is in the valve closed position and the closure cap 62 is threadedly seated on the end 60 of the valve body 32. It will be noted that the closure cap 62 having an outer diameter greater than the diameter of the side wall opening 34 must initially be removed from the valve body 32 before the valve is inserted through the opening 34.

The plastic bag 28 is now filled from the top. Once the container is filled, the bag is closed and the top cap 20 is placed on the container. The container may then be secured by bands 26 to a pallet 24 and shipped to a desired location (FIG. 1) When it is desired to drain the container, the closure cap 62 is first removed. A drain tube (not shown) which may have an internally threaded end like the closure cap is then screwed onto the end 60 of valve body 32. The operator inserts a screwdriver into the slotted head 58 and turns the butterfly 54 90° to open the valve. It is to be recognized that the valve may be opened and closed by this method as many times as desired.

Once the container is emptied, it is desired to knock the container down to permit its shipment in a substantially flat condition back for reuse. In this connection, the drain tube is first removed from the valve body. The handle 48 is then pulled off the valve body 32 by the operator's grasping the handle 48 and pulling it away from the valve 30 with the tangs 50 flexing around the valve body 32 in the recess 46. The valve body is then pushed inwardly through the opening 34 in the bulk container side wall permitting removal of the plastic liner from the container side wall. The plastic container is then folded into the base and the top cap placed thereon. The side wall is folded to a flat condition for shipping.

Thus having described the invention, what is claimed is:

1. A valve for a bulk container including a side wall and a plastic bag for containing fluid or semi-fluid material in the bulk container, comprising:

a tubular valve body having a through opening therein;

valve means mounted in said through opening movable between a valve open and valve closed position;

an annular flange at one end of said valve body adapted to be sealingly secured to said plastic bag;

an annular recess in said valve body spaced from said annular flange by a distance equal to about the thickness of said side wall of said bulk container;

said valve body being adapted to pass through an opening in said side wall of said bulk container with said annular flange being on the inside of said container and said annular recess being on the outside of said container; and removable handle means receivable in said recess to secure said valve in said side wall of said bulk container.

2. The valve of claim 1 further comprising at least one projection on the outside of said valve body adapted to be received in a notch extending from the circumference of said opening in the side wall of said container for preventing rotation of the valve in the side wall of said container.

3. The valve of claim 1 wherein said valve means comprises a butterfly rotatably mounted in the valve body and including means external of the valve body permitting opening and closing of said butterfly.

4. The valve of claim 3 wherein said tubular valve body further comprises a threaded end portion opposite said annular flange and wherein said valve further comprises a threaded closure cap to be received on said end portion, said closure cap including a recessed portion adapted to engage said butterfly on closing of said butterfly to prevent opening of said butterfly.

5. The valve of claim 1 wherein said handle means includes a pair of flexible, semi-circular tangs adapted to flex about said valve body and snap into said annular recess to secure said valve in said side wall of said bulk container.

* * * * *